US011371510B2

(12) United States Patent
Fielder et al.

(10) Patent No.: US 11,371,510 B2
(45) Date of Patent: Jun. 28, 2022

(54) TEST SYSTEM FLUID EVACUATION

(71) Applicant: Halliburton Energy Services, Inc., Houston, TX (US)

(72) Inventors: Vance Lee Fielder, Dewey, OK (US); Bryan Don Mullins, Claremore, OK (US); Trevor Alan Kopecky, Owasso, OK (US); Donn J. Brown, Broken Arrow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 440 days.

(21) Appl. No.: 16/574,557

(22) Filed: Sep. 18, 2019

(65) Prior Publication Data

US 2021/0079921 A1 Mar. 18, 2021

(51) Int. Cl.

| | |
|---|---|
| ***F04D 15/00*** | (2006.01) |
| ***F04D 13/10*** | (2006.01) |
| *E21B 43/12* | (2006.01) |

(52) U.S. Cl.

CPC ..... *F04D 15/0088* (2013.01); *F04D 13/10* (2013.01); *F04D 15/0005* (2013.01); *E21B 43/128* (2013.01)

(58) Field of Classification Search

CPC .. F04D 15/0088; F04D 15/0005; F04D 13/10; E21B 43/128

USPC ..... 73/168

See application file for complete search history.

(56) References Cited

U.S. PATENT DOCUMENTS

| | | | | |
|---|---|---|---|---|
| 4,290,305 | A * | 9/1981 | Gibson | E21B 21/08 73/152.49 |
| 4,387,833 | A | 6/1983 | Venus, Jr. | |
| 4,782,689 | A | 11/1988 | DeRome | |
| 4,901,563 | A * | 2/1990 | Pearson | E21B 43/2607 166/308.1 |
| 2003/0176833 | A1 | 9/2003 | Libermann | |
| 2009/0255331 | A1* | 10/2009 | Weis | F04D 15/0088 73/168 |

FOREIGN PATENT DOCUMENTS

| | | | |
|---|---|---|---|
| CN | 202255701 U | * | 5/2012 |
| CN | 202255701 U | | 5/2012 |
| CN | 206339073 U | * | 7/2017 |
| CN | 206339073 U | | 7/2017 |
| KR | 101889294 B1 | | 8/2018 |

OTHER PUBLICATIONS

Translation of CN-206339073-U, Deng et al (Year: 2017).*
Translation of CN-202255701-U, Liu et al (Year: 2012).*
Foreign Communication From Related Application—International Search Report and Written Opinion of the International Searching Authority, International Application No. PCT/US2019/052717, dated Jun. 15, 2020, 15 pages.

* cited by examiner

*Primary Examiner* — Nathaniel T Woodward
(74) *Attorney, Agent, or Firm* — Conley Rose, P.C.; Rodney B. Carroll

(57) ABSTRACT

A fluid pump test system. The fluid pump test system comprises a plurality of fluid tanks, each different fluid tank holding a different test fluid, a fluid plumbing, a plurality of valves coupling the fluid tanks to the fluid plumbing, and a compressed air source coupled to the fluid plumbing.

20 Claims, 5 Drawing Sheets

TEST SYSTEM FLUID EVACUATION

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Fluid pumps have application in many systems. For example, centrifugal pumps may be deployed downhole in a wellbore and driven by an electric motor receiving power from the surface via an electric power cable to lift fluids from a pump inlet to the surface. Pumps perform differently under different conditions, for example when pumping fluids having different viscosities, when pumping fluids to produce different inlet to outlet pressure differentials, when driven with different speeds and/or different torque. When designing a system that makes use of a fluid pump it may be desirable to have test data that represents the performance of the fluid pump under different conditions.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

For some fluid pumps it is desirable to test pump performance while pumping fluids of different viscosity because the pumps may encounter fluids of varying or unpredictable viscosity when put into use. For example, electric submersible pumps (ESPs) are placed in a wellbore and pump wellbore fluids from a downhole location to the surface. The viscosity of the wellbore fluids pumped by ESPs may vary over a range of viscosities based on a variety of different factors that may not be fully understood or entirely predictable before completing a well (e.g., before deploying the ESP to the well). The viscosity of the wellbore fluids pumped by an ESP may vary over time. Accurate test data on fluid pumps can contribute to improved design of systems employing fluid pumps. Testing fluid pumps by pumping fluids having different viscosities, however, may entail changing from pumping a first test fluid associated with a first range of viscosities to a second different test fluid associated with a second range of viscosities. Opening a drain plug at a low point in the pump testing system and allowing the first test fluid to drain may entail an undesirable time duration and may not effectively clear the first test fluid from the pump testing system. Additionally, dumping the test fluid into a drain pan can lead to spills and time consuming, expensive clean ups. When drained test fluid is collected, in some jurisdictions the test fluid must be handled as hazardous waste, entailing additional costs and further contributing to an undesirable accumulation of hazardous waste. The loss of test fluid at the completion of a test also involves costs in replacing the lost test fluid before a next test cycle, for example a test of a different fluid pump. Therefore there is a need for an improved pump test system that does not rely upon draining and disposing of test fluid.

The present disclosure teaches a fluid pump test system that introduces compressed air into the system after completing testing with a first test fluid, forcing the first test fluid out of the testing apparatus and back into a tank containing the first test fluid. In this way, time is saved in draining the first test fluid, spills are avoided, hazardous waste is not generated, and expensive test fluid is not lost but instead is recovered for reuse in future test cycles.

Figure 1:
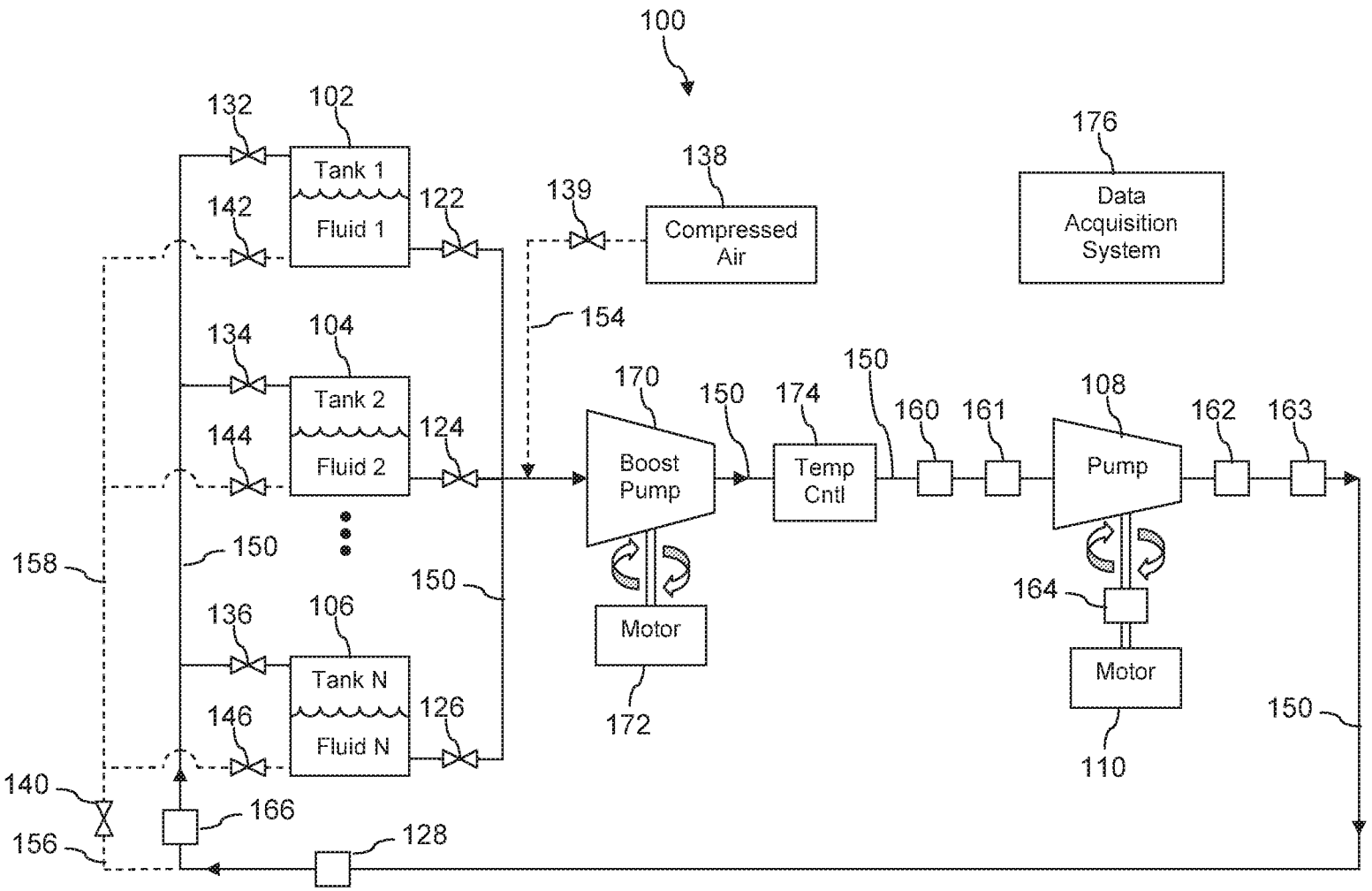
FIG. 1 is an illustration of a test system according to an embodiment of the disclosure.

Turning now to FIG. 1, a fluid pump test system 100 is described. In embodiments, the system 100 comprises a plurality of test fluid tanks storing different test fluids, for example a first tank 102, a second tank 104, and a third tank 106. The first test fluid stored by the first tank 102 may be flowed to first plumbing 150 by opening a first valve 122 and returned to the first tank 102 via first plumbing 150 through a second value 132. The first plumbing provides a supply flow path from the various tanks supplying the test fluid to the pump being tested and a return flow path returning the test fluid from the pump being tested to the tank supplying the test fluid. The second test fluid stored by the second tank 104 may be flowed to first plumbing 150 by opening a third valve 124 and returned to the second tank 104 via first plumbing 150 through a fourth valve 134. The third test fluid stored by the third tank 106 may be flowed to first plumbing 150 by opening a fifth valve 126 and returned to the third tank 106 via first plumbing 150 through a sixth valve 136.

In embodiments, the system 100 comprises a fluid pump under test 108 (i.e., a pump that is coupled to and in fluid communication with the first plumping 150 and is undergoing a test procedure) that may be turned by first electric motor 110 to pump test fluid received from the first plumbing 150 and output to the first plumbing 150 through a first control valve 128. The first control valve 128 may reduce the pressure of fluid in the first plumbing 150 as it returns to one of the tanks 102, 104, 106. The first control valve 128 may be an electrically actuated valve. The fluid pump under test 108 may be removed and replaced by a different fluid pump to test a different pump.

In embodiments, the system 100 comprises a source of compressed air 138 and an air supply valve 139. The compressed air 138 is coupled to the first plumbing 150 by second plumbing 154. To drain test fluid from the system 100, the valves 122, 124, 126, 132, 134, and 136 may all be closed, and one of a first recovery valve 142 associated with the first tank 102, a second recovery valve 144 associated with the second tank 104, and a third recovery valve 146 associated with the third tank 106 is opened. A seventh valve 140 coupling a third plumbing 156 to a fourth plumbing 158 may also be opened. The compressed air enters the second plumbing 154, flows into the first plumbing 150, drives test fluid downstream in the first plumbing 150, out of the fluid pump under test 108, further downstream in the first plumbing 150, into the third plumbing 156, through the seventh valve 140, into the fourth plumbing 158, and through the opened one of the recovery valves 142, 144, 146 into the associated tank 102, 104, 106. In embodiments, the recovery valves 142, 144, 146 and/or plumbing coupling the valves 142, 144, 146 to the tanks 102, 104, 106 may desirably be attached to the tanks 102, 104, 106 at a point low relative to grade on the tanks 102, 104, 106.

The compressed air thus evacuates the test fluid from the plumbing 150 and from the fluid pump under test 108 promptly and with recovery of the test fluid for use in future tests. In embodiments, the third plumbing 156 and fourth plumbing 158 may be provided by transparent lines that promote observation of the presence of test fluid in the plumbing 156, 158 and determination when the test fluid has stopped flowing (e.g., determination that evacuation of the test fluid has completed). When the evacuation of test fluid has completed, the air supply valve 139, the seventh valve 140, and the one of the recovery valves 142, 144, 146 may be closed. It is noted that residual test fluid may remain in the first plumbing 150 and/or trapped in interior chambers of the fluid pump under test 108, but this residual test fluid is negligible in volume (e.g., less than 5, 4, 3, 2, or 1% of the total volume of the first plumbing 150) and does not interfere with further testing of the fluid pump under test 108 using different test fluids.

In embodiments, the system 100 may comprise additional components in fluid communication with the first plumbing 150. The system 100 may comprise a boost pump 170 that is driven by a second electric motor 172. The boost pump 170 is disposed in the flow path provided by first plumbing 150 and may establish a desired inlet fluid pressure for the fluid pump under test 108. The system 100 may comprise a temperature control system 174 disposed in flow path provided by the first plumbing 150 that can increase or decrease the temperature of the test fluid received from the tanks 102, 104, 106. Heating or cooling test fluid changes the viscosity of the test fluid and promotes testing the fluid pump under test 108 while pumping fluids of different viscosities. The system 100 may comprise a first temperature sensor 160, a first pressure sensor 161, a second pressure sensor 162, a second temperature sensor 163, a torque sensor 164, and a flow sensor 166 disposed in various locations within the flow path provided by first plumbing 150 as shown in FIG. 1. In embodiments, the first electric motor 110 may be rated to produce about 500 horsepower of power (about 373,000 watts) and the second electric motor 172 may rated to produce about 125 horsepower of power (about 93,200 watts). In other embodiments, the electric motors 110, 172 may be rated to produce power different from these power levels.

It is understood that the system 100 may have any suitable number of tanks, as represented by "Tank "N" and corresponding "Fluid N" in FIG. 1. It is understood that the system 100 may comprise two tanks 102, 104, three tanks 102, 104, 106, or more than three tanks and a corresponding additional valves and recovery valves to couple additional tanks to first plumbing 150 and fourth plumbing 158. In embodiments, the tanks 102, 104, 106 may have vents or check valves located near their tops to avoid establishment of either a vacuum or build-up of air pressure within the tanks 102, 104, 106.

The system 100 may further comprise a data acquisition system 176 coupled to various components disposed in the flow path provided by the first plumbing 150 that provides control inputs and receives sensor outputs. In embodiments, the data acquisition system 176 is implemented on a computer system that provides an interface to test operators and promotes selections of inputs to control the test system 100 and to perform testing of the fluid pump under test 108, to capture test data, and to analyze the test data. The data acquisition system 176 may analyze the raw data collected from the sensors 160, 161, 162, 163, 164, 166 and generate fluid pump performance reports in a form suitable for promulgation to customers, designers, and/or users of the fluid pump under test 108. The data acquisition system 176 may be electrically coupled to the sensors 160, 161, 162, 163, 164 and to the first control valve 128. The first motor 110 may receive electric power from a first variable speed drive (VSD), and the second motor 172 may receive electric power from a second VSD. The first and second VSDs may be connected to main electric power and may be controlled by the data acquisition system 176.

In embodiments, the first tank 102 may comprise a first test fluid that exhibits a viscosity of 10 centipoise (cP) at about 130 degrees Fahrenheit (F.) and 25 cP at about 85 degrees F. In embodiments, the second tank 104 may comprise a second test fluid that exhibits a viscosity of 25 cP at about 145 degrees F., 50 cP at about 118 degrees F., 75 cP at about 100 degrees F., 100 cP at about 91 degrees F., and 150 cP at about 75 degrees F. In embodiments, the third tank 106 may comprise a third test fluid that exhibits a viscosity of 200 cP at about 130 degrees F., 300 cP at about 125 degrees F., 500 cP at about 98 degrees F., and 750 cP at about 85 degrees F. In embodiments, a fourth tank (not shown) may comprise a fourth test fluid that exhibits a viscosity of 750 cP at about 130 degrees F., 1000 cP at about 125 degrees F., 1250 cP at about 120 degrees F., 1500 cP at about 110 degrees F., 1750 cP at about 105 degrees F., 2000 cP at about 100 degrees F., 2250 cP at about 95 degrees F., and 2500 cP at about 90 degrees F. By changing test fluids circulated by the fluid pump under test 108 and by controlling the temperature of the test fluids, the fluid pump under test 108 can be tested while pumping fluids of a wide range of viscosity, for example fluids at viscosities of each of 10 cP, 25 cP, 50 cP, 75 cP, 100 cP, 150 cP, 200 cP, 300 cP, 500 cP, 750 cP, 1000 cP, 1250 cP, 1500 cP, 1750 cP, 2000 cP, 2250 cP, and 2500 cP. In embodiments, the tanks 102, 104, 106 may each store about 1000 gallons of test fluid.

In an embodiment, the system 100 may comprise two tanks each containing different test fluids where the two different test fluids have substantially similar viscosity ranges, for example a first tank storing water and a second tank storing kerosene.

Expressing the above information using SI units, the first tank 102 may comprise a first test fluid that exhibits a viscosity of 0.010 Pascal seconds (Pa-s) at about 328 degrees Kelvin (K) and 0.025 Pa-s at about 303 degrees K. In embodiments, the second tank 104 may comprise a second test fluid that exhibits a viscosity of 0.025 Pa-s at about 336 degrees K, 0.050 Pa-s at about 321 degrees K, 0.075 Pa-s at about 311 degrees K, 0.10 Pa-s at about 306 degrees K, and 0.15 Pa-s at about 297 degrees K. In embodiments, the third tank 106 may comprise a third test fluid that exhibits a viscosity of 0.20 Pa-s at about 328 degrees K, 0.30 Pa-s at about 325 degrees K, 0.50 Pa-s at about 310 degrees K, and 0.75 Pa-s at about 303 degrees K. In embodiments, a fourth tank (not shown) may comprise a fourth test fluid that exhibits a viscosity of 0.75 Pa-s at about 328 degrees K, 1.00 Pa-s at about 325 degrees K, 1.25 Pa-s at about 322 degrees K, 1.50 Pa-s at about 316 degrees K, 1.75 Pa-s at about 314 degrees K, 2.00 Pa-s at about 311 degrees K, 2.25 Pa-s at about 308 degrees K, and 2.50 Pa-s at about 305 degrees K. By changing test fluids circulated by the fluid pump under test 108 and by controlling the temperature of the test fluids, the fluid pump under test 108 can be tested while pumping fluids of a wide range of viscosity, for example fluids at viscosities of each of 0.010 Pa-s, 0.025 Pa-s, 0.050 Pa-s, 0.075 Pa-s, 0.10 Pa-s, 0.15 Pa-s, 0.20 Pa-s, 0.30 Pa-s, 0.50 Pa-s, 0.75 Pa-s, 1.00 Pa-s, 1.25 Pa-s, 1.50 Pa-s, 1.75 Pa-s, 2.00 Pa-s, 2.25 Pa-s, and 2.50 Pa-s. In embodiments, the tanks 102, 104, 106 may each store about 3785 liters of test fluid.

Figure 2:
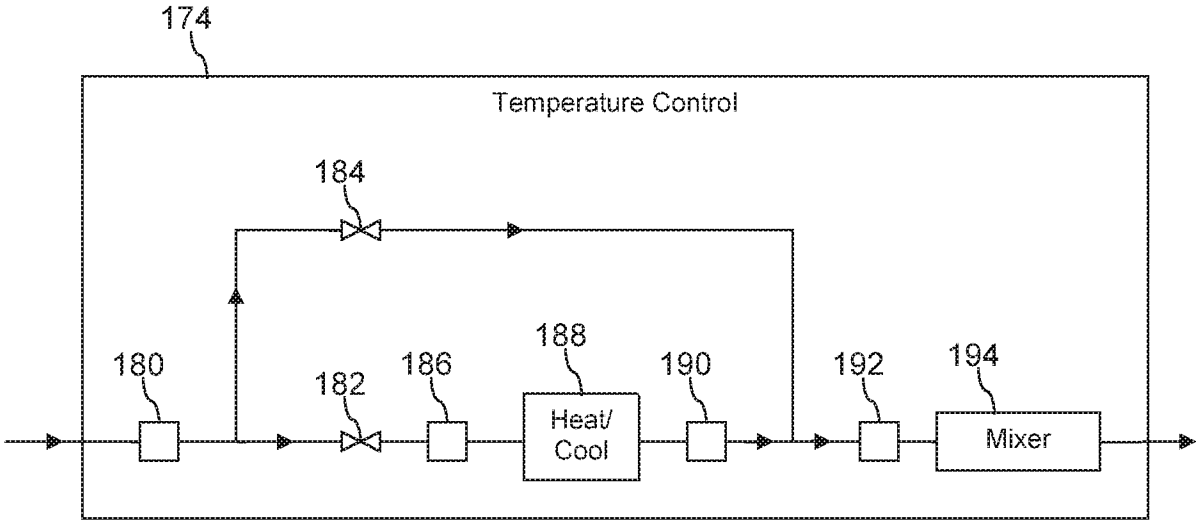
FIG. 2 is an illustration of fluid temperature control component according to an embodiment of the disclosure.

Turning now to FIG. 2, further details of a temperature control system 174 are described. In embodiments, the system 174 may comprise a third temperature sensor 180, a second control valve 182, a third control valve 184, a fourth temperature sensor 186, a heater/cooler unit 188, a fifth temperature sensor 190, a sixth temperature sensor 192, and a mixer 194, each disposed within a flow path provided by the first plumbing 150. In some embodiments, the system 100 and/or the temperature control system 174 may have more temperature sensors or fewer temperature sensors. Additionally, the temperature sensors may be located at different points in the plumbing of the system 100 and/or the temperature control system 174.

The control valves 182, 184 may be electrically actuated valves. The control valves 182, 184 may be controlled and/or modulated by the data acquisition system 176. The control valves 182, 184 may be modulated by the data acquisition system 176 to maintain a desired fluid pressure at the inlet of the fluid pump under test 108 and to maintain a desired blend of test fluid passing through the heater/cooler unit 188 and fluid bypassing the heater/cooler unit 188. By modulating the blend of test fluid that bypasses versus the test fluid that passes through the heater/cooler unit 188 a desired temperature of the test fluid may be maintained, as measured by the sixth temperature sensor 192 and/or by the first temperature sensor 160. The desired temperature of the test fluid may also be maintained by the data acquisition system 176 controlling the amount of cooling or the amount of heating performed by the heater/cooler unit 188. The mixer 194 may be a passive component that introduces turbulence in the test fluid passing through to deter the segregation of the fluid flow into different temperature stratum.

Figure 3:
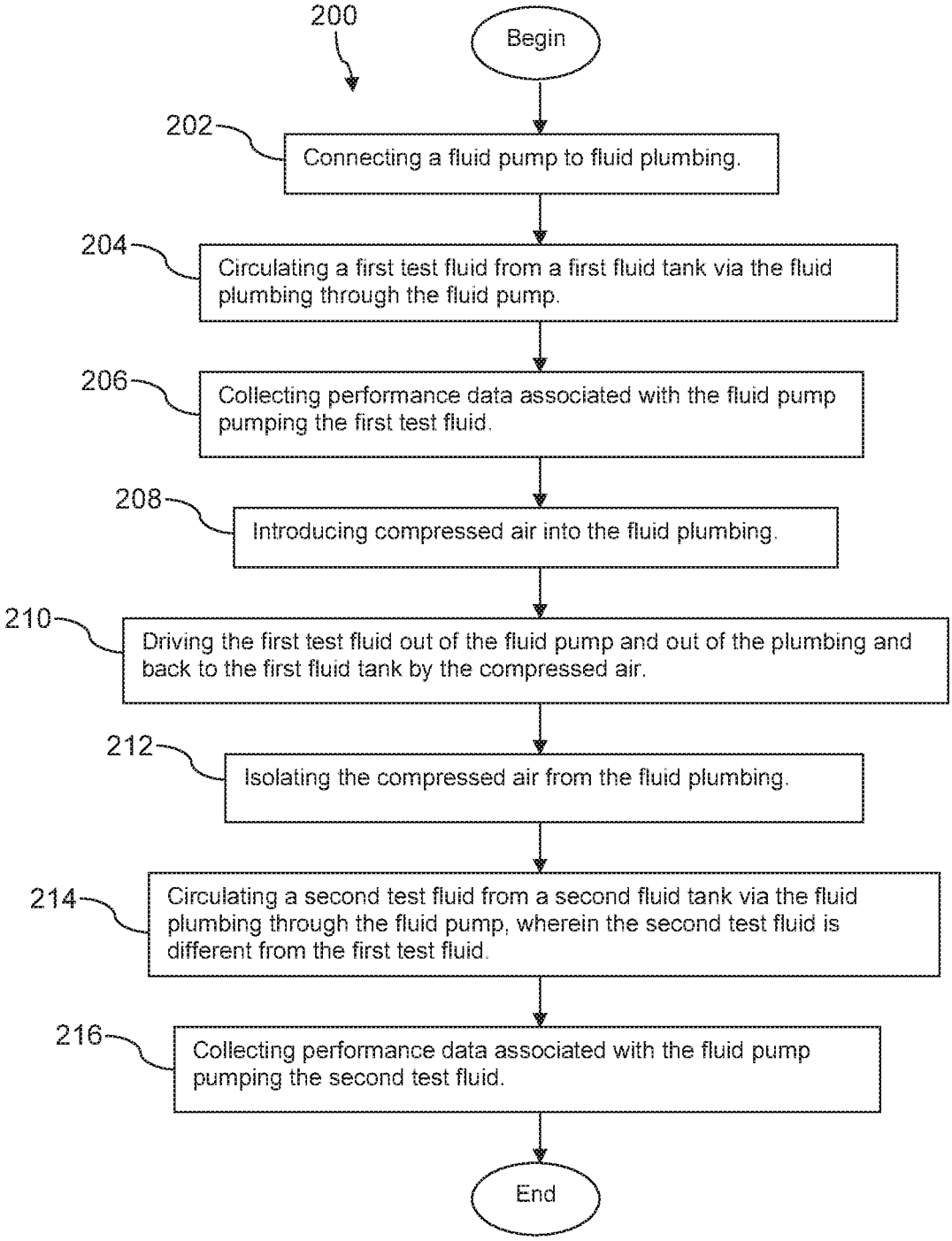
FIG. 3 is a flow chart of a method of testing a fluid pump according to an embodiment of the disclosure.

Turning now to FIG. 3, a method 200 is described. In embodiments, the method 200 is a method of testing a fluid pump. In an aspect, the pump may be a multistage centrifugal pump configured for use in a wellbore, for example as part of an electrical submersible pump (ESP) assembly in a completed hydrocarbon producing well. The test pump may also be referred to as a fluid end which is coupled to a power end such as motor 110. At block 202, the method 200 comprises connecting a fluid pump to fluid plumbing. The activity of block 202 may comprise attaching an inlet of the fluid pump under test 108 to the first plumbing 150 downstream of the first pressure sensor 161 and attaching an outlet of the fluid pump under test 108 to the first plumbing 150 upstream of the second pressure sensor 162. The activity of block 202 may comprise mechanically coupling a drive shaft of the fluid pump under test 108 to a drive shaft of the first electric motor 110. In embodiments, the torque sensor 164 may be located between the drive shafts.

At block 204, the method 200 comprises circulating a first test fluid from a first fluid tank via the fluid plumbing through the fluid pump. The activity of block 204 may comprise opening one of the valves 122, 124, 126 and a corresponding one of the valves 132, 134, 136. For example, if the first test fluid is provided from the first tank 102, the activity of block 204 may comprise opening valve 122 and opening valve 132. The activity of block 204 may comprise the second electric motor turning the boost pump 170 at a desired speed for building a desired fluid pressure of the test fluid for input to the inlet of the fluid pump under test 108. The activity of block 204 may comprise the first electric motor 110 turning the fluid pump under test 108 at a desired speed and/or delivering a desired torque to the drive shaft of the fluid pump under test 108. The activity of block 204 may comprise modulating the control valves 128, 182, 184 to achieve a desired fluid flow rate in the first plumbing 150. The activity of block 204 may comprise modulating the heater/cooler unit 188 and the control valves 182, 184 to deliver test fluid at a desired temperature to the inlet of the fluid pump under test 108. The data acquisition system 176 may send command signals to the motors 110, 172, to the control valves 128, 182, 184, and to the heater/cooler unit 188 to achieve desired test conditions.

At block 206, the method 200 comprises collecting performance data associated with the fluid pump pumping the first test fluid. The activity of block 206 may comprise the data acquisition system 176 receiving sensor outputs and storing them in a memory. For example, the data acquisition system 176 may receive and store temperature values from the temperature sensors 160, 163, 180, 186, 190, 192. The data acquisition system 176 may receive and store pressure values from pressure sensors 161, 162. The data acquisition system 176 may receive and store flow rate values from the flow rate sensor 166. The data acquisition system 176 may receive and store torque values from the torque sensor 164. It is understood that the data acquisition system 176 may store a plurality of each of the different values received from the sensors, for example a first pressure value received from the first pressure sensor 161 associated with a first time, a second pressure value received from the first pressure sensor 161 associated with a second time, a third pressure value received from the first pressure sensor 161 associated with a third time, and so on. The data acquisition system 176 may store each sensor value associated with a timestamp.

In embodiments, the activity of block 206 may comprise changing a temperature of the test fluid to promote the test fluid exhibiting a different viscosity. During a temperature transition, the dispositions of the second control valve 182, the third control valve 184, and the heater/cooler unit 188 may be changed by the data acquisition system 176. During a transition time period, the data acquisition system 176 may stop collecting performance data until the system 100 achieves steady state at the new operating regime. For some test fluids, the activity of block 206 may change temperature of the test fluid several times. For example, when employing the fourth test fluid described above, the activity of block 206 may comprising changing the temperature of the test fluid six or seven times. The activity of block 206, may further comprise discontinuing the pumping upon completion of the testing for a given fluid.

At block 208, the method 200 comprises introducing compressed air into the fluid plumbing. The activity of block 208 may be performed when it is desired to stopping testing the fluid pump under test 108 using one test fluid and resume testing the fluid pump under test 108 using a different test fluid. Before the activity of block 208 is performed, the electric motors 110, 172 are turned off and the pumps 108, 170 are not pumping test fluid in the first plumbing 150. Additionally, before the activity of block 208 is performed, all of the valves 122, 124, 126, 132, 134, 136 may desirably be closed. Typically, one pair of associated valves—122/132, 124/134, or 126/136—is open prior to block 208 and only these two open valves need to be changed from open to closed. Compressed air may be introduced into the fluid plumbing, for example into the first plumbing 150, by opening the air supply valve 139.

At block 210, the method 200 comprises driving the first test fluid out of the fluid pump and out of the plumbing and back to the first fluid tank by the compressed air. The activity of block 210 may comprise opening the seventh valve 140 and opening one of the recovery valves 142, 144, 146. The one of the recovery valves opened corresponds to the test fluid being evacuated from the plumbing. For example, if the first test fluid associated with the first tank 102 is being evacuated, the first recovery valve 142 is opened; if the second test fluid associated with the second tank 104 is being evacuated, the second recovery valve 144 is opened; and if the third test fluid associated with the third tank 106 is being evacuated, the third recovery valve 146 is opened. The activity of block 210 may comprise a test operator observing test fluid flow in the third plumbing 156 and/or the fourth plumbing 158 to determine when the evacuation of the test fluid from the plumbing 150 and from the pumps 108, 170 has been completed. The third plumbing 156 and/or the fourth plumbing 158 may comprise transparent hosing. Alternatively, the third plumbing 156 and/or the fourth plumbing 158 may incorporate a sight glass component that promotes observing presence of test fluid.

At block 212, the method 200 comprises isolating the compressed air from the fluid plumbing. The activity of block 212 may comprise closing the air supply valve 139. The activity of block 212 may comprise closing the recovery valve 142, 144, 146 that was opened in block 210 and closing the seventh valve 140.

At block 214, the method 200 comprises circulating a second test fluid from a second fluid tank via the fluid plumbing through the fluid pump, wherein the second test fluid is different from the first test fluid. In an embodiment, each different test fluid is associated with a different range of viscosities. In another embodiment, however, at least some of the different test fluids may be associated with substantially similar ranges of viscosity. For example, in an embodiment, a first test fluid may be water and a second test fluid may be kerosene. Water and kerosene would be different test fluids, but the viscosity range of water and the viscosity range of kerosene may be substantially similar to each other. The activity of block 214 may comprise opening one of the valves 122, 124, 126 and a corresponding one of the valves 132, 134, 136. For example, if the first test fluid is provided from the second tank 104, the activity of block 214 may comprise opening valve 124 and opening valve 134. The activity of block 214 may comprise the second electric motor 172 turning the boost pump 170 at a desired speed for building a desired fluid pressure of the test fluid for input to the inlet of the fluid pump under test 108. The activity of block 214 may comprise the first electric motor 110 turning the fluid pump under test 108 at a desired speed and/or delivering a desired torque to the drive shaft of the fluid pump under test 108. The activity of block 214 may comprise modulating the control valves 128, 182, 184 to achieve a desired fluid flow rate in the first plumbing 150. The activity of block 214 may comprise modulating the heater/cooler unit 188 and the control valves 182, 184 to deliver test fluid at a desired temperature to the inlet of the fluid pump under test 108. The data acquisition system 176 may send command signals to the electric motors 110, 172, the control valves 128, 182, 184, and to the heater/cooler unit 188 to achieve desired test conditions. The method 200 may further comprise repeating the activities associated with blocks 206 to 214 to test as many fluids as desired for a given pump, for example applying the method to a test system 100 having a plurality of testing fluid stored in a corresponding plurality of storage tanks (e.g., 3, 4, 5, 6, 7, 8, 9, 10, or more testing fluids and tanks).

At block 216, the method 200 comprises collecting performance data associated with the fluid pump pumping the second test fluid. The activity of block 216 may be similar to the activity performed at block 206 described above.

Figure 4A:
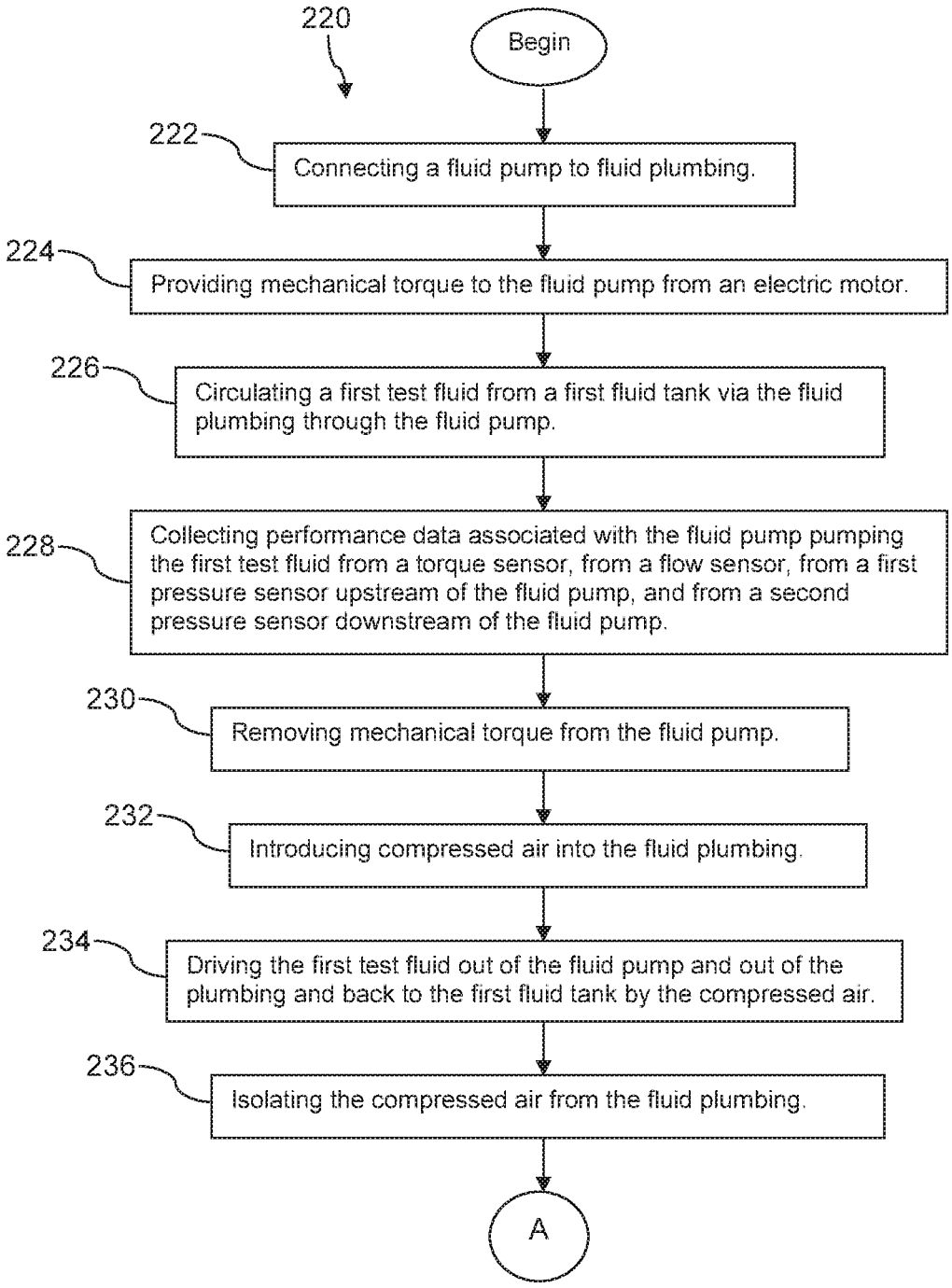
FIG. 4A and FIG. 4B are a flow chart of another method of testing a fluid pump according to an embodiment of the disclosure.
Figure 4B:
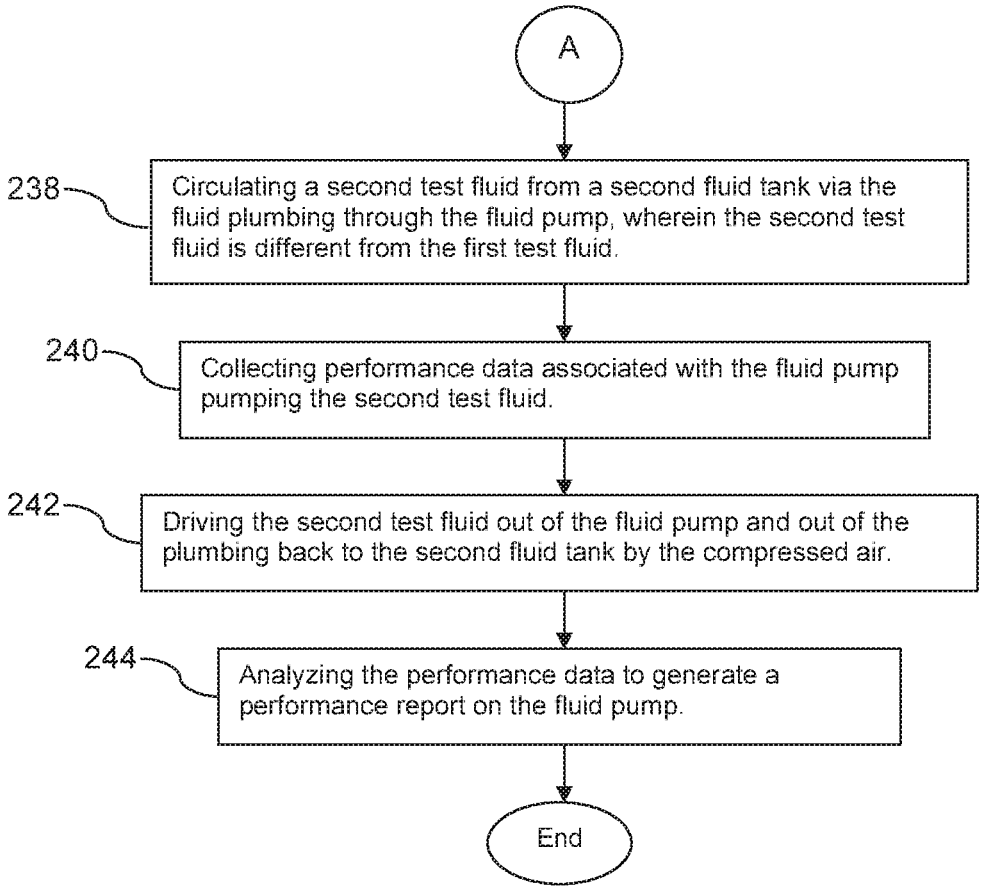

Turning now to FIG. 4A and FIG. 4B, a method 220 is described. In embodiments, the method 220 is a method of testing a fluid pump. At block 222, the method 220 comprises connecting a fluid pump to fluid plumbing. In an aspect, the pump may be a multistage centrifugal pump configured for use in a wellbore, for example as part of an electrical submersible pump (ESP) assembly in a completed hydrocarbon producing well. The test pump may also be referred to as a fluid end which is coupled to a power end such as motor 110.

At block 224, the method 220 comprises providing mechanical torque to the fluid pump from an electric motor. At block 226, the method 220 comprises circulating a first test fluid from a first fluid tank via the fluid plumbing through the fluid pump.

At block 228, the method 220 comprises collecting performance data associated with the fluid pump pumping the first test fluid from a torque sensor, from a flow sensor, from a first pressure sensor upstream of the fluid pump, and from a second pressure sensor downstream of the fluid pump. At block 230, the method 220 comprises removing mechanical torque from the fluid pump. After removing the mechanical torque from the fluid pump and before performing the action of block 232 below, in an embodiment the first fluid tank may be isolated from the fluid plumbing, for example by closing a supply valve associated with the first fluid tank.

At block 232, the method 220 comprises introducing compressed air into the fluid plumbing. At block 234, the method 220 comprises driving the first test fluid out of the fluid pump and out of the plumbing and back to the first fluid tank by the compressed air.

At block 236, the method 220 comprises isolating the compressed air from the fluid plumbing. At block 238, the method 220 comprises circulating a second test fluid from a second fluid tank via the fluid plumbing through the fluid pump, wherein the second test fluid is different from the first test fluid. In an embodiment, each different test fluid is associated with a different range of viscosities. Alternatively, at least some of the test fluids may be different while still being associated with substantially the same range of viscosities. For example, in an embodiment the first test fluid may be water and the second test fluid may be kerosene. At block 240, the method 220 comprises collecting performance data associated with the fluid pump pumping the second test fluid. Before performing the action of block 242 below, in an embodiment the second fluid tank may be isolated from the fluid plumbing, for example by closing a supply valve associated with the second fluid tank.

At block 242, the method 220 comprises driving the second test fluid out of the fluid pump and out of the plumbing back to the second fluid tank by the compressed air. The method 220 may further comprise repeating the activities associated with blocks 224 to 242 to test as many fluids as desired for a given pump, for example applying the method to a test system 100 having a plurality of testing fluid stored in a corresponding plurality of storage tanks (e.g., 3, 4, 5, 6, 7, 8, 9, 10, or more testing fluids and tanks).

At block 244, the method 220 comprises analyzing the performance data to generate a performance report on the fluid pump. The activity of block 244 may be performed by the data acquisition system 176. The analyzing may comprise aligning sensor data at approximately the same times to create data snapshots that can be analyzed. For example, sensor data falling in a first time slice are associated to a first data snapshot by the data acquisition system 176; sensor data falling in a second time slice are associated to a second data snapshot by the data acquisition system 176; and sensor data falling in a third time slice are associated to a third data snapshot of the data acquisition system 176. Data snapshots may be associated with a particular viscosity of test fluid by the data acquisition system 176 based on the time slice. For example, the snapshots 1-99 may be associated with operation of the test system 100 with a test fluid exhibiting a viscosity of 500 cP (0.5 Pa-s), the snapshots 100-199 may be associated with operation of the test system 100 with a test fluid exhibiting a viscosity of 750 cP (0.75 Pa-s), and the snapshots 200-299 may be associated with operation of the test system 100 with a test fluid exhibiting a viscosity of 1000 cP (1.00 Pa-s). The snapshots can be analyzed by the data acquisition system 176 to determine performance of the fluid pump under test 108 while pumping test fluid having a particular viscosity. The final report can represent pump performance at each of the different viscosities tested.

The method 200 and/or the method 220 can be performed for a first test pump (e.g., a first downhole multistage centrifugal pump), and subsequently the first test pump can be removed from system 100 and be replaced with a second test pump (e.g., a second downhole multistage centrifugal pump that may be configured the same or differently from the first) and method 200 and/or method 220 can be performed on the second test pump. Evacuating the lines between change-out of test pumps provides a further advantage of reduced exposure to hazardous materials and reduced consumption (e.g., waste) of test fluid.

The following are non-limiting specific embodiments in accordance with the present disclosure. In a first example, a fluid pump test system comprises a fluid pump; a plurality of fluid tanks, each different fluid tank holding a different test fluid; a fluid plumbing providing a supply fluid flow path for supply of a test fluid from the plurality of tanks to the fluid pump and a return fluid flow path for return of the test fluid from the fluid pump to the plurality of fluid tanks; a plurality of valves coupling the fluid tanks in fluid communication with the fluid plumbing; and a compressed air source coupled to the fluid plumbing. In a second example, the fluid pump test system of example 1 comprises a test fluid temperature control system in fluid communication with the supply fluid flow path. In a third example, the fluid pump test system of example 1 or example 2 comprises two fluid tanks, wherein a first fluid tank stores a first test fluid that exhibits a viscosity of 25 cP at about 145 degrees F., 50 cP at about 118 degrees F., 75 cP at about 100 degrees F., 100 cP at about 91 degrees F., and 150 cP at about 75 degrees F.; and a second fluid tank stores a second test fluid that exhibits a viscosity of 200 cP at about 130 degrees F., 300 cP at about 125 degrees F., 500 cP at about 98 degrees F., and 750 cP at about 85 degrees F. In a fourth example, the fluid pump test system of example three comprises three fluid tanks, wherein a third fluid tank stores a third test fluid that exhibits a viscosity of 750 cP at about 130 degrees F., 1000 cP at about 125 degrees F., 1250 cP at about 120 degrees F., 1500 cP at about 110 degrees F., 1750 cP at about 105 degrees F., 2000 cP at about 100 degrees F., 2250 cP at about 95 degrees F., and 2500 cP at about 90 degrees F. In a fifth example, the fluid pump test system of the fourth example comprises four fluid tanks, wherein a fourth fluid tank stores a fourth test fluid that exhibits a viscosity of 10 centipoise (cP) at about 130 degrees Fahrenheit (F.) and 25 cP at about 85 degrees F. In a sixth example, the fluid pump test system of example 1, example 2, example 3, example 4, or example 5, wherein each different test fluid is associated with a different range of viscosities.

In a seventh example, a method of testing a fluid pump comprises connecting a fluid pump to fluid plumbing; circulating a first test fluid from a first fluid tank via the fluid plumbing through the fluid pump and back to the first fluid tank; collecting performance data associated with the fluid pump pumping the first test fluid; discontinuing the circulating of the first test fluid; introducing compressed air into the fluid plumbing; driving the first test fluid out of the fluid pump and out of the plumbing and back to the first fluid tank by the compressed air; isolating the compressed air from the fluid plumbing; circulating a second test fluid from a second fluid tank via the fluid plumbing through the fluid pump and back to the second fluid tank, wherein the second test fluid is different from the first test fluid and wherein each different test fluid is associated with a different range of viscosities; and collecting performance data associated with the fluid pump pumping the second test fluid. In an eighth example, the method of example 7 comprises connecting a drive shaft of the fluid pump to a drive shaft of an electric motor. In a ninth example, the method of example 7 or example 8 comprises heating the first test fluid, the second test fluid, or both. In a tenth example, the method of example 7, example 8, or example 9 comprises cooling the first test fluid, the second test fluid, or both. An eleventh example is the method of claim example, example 8, example 9, or example 10, wherein driving the first test fluid back to the first fluid tank comprises driving the first test fluid through a first evacuation valve. A twelfth example is the method of example 7, example 8, example 9, example 10, or example 11, wherein introducing compressed air comprises opening an air supply valve and isolating the compressed air comprises closing the air supply valve. A thirteenth example is the method of example 7, example 8, example 9, example 10, example 11, or example 12, wherein collecting performance data comprises receiving inputs from sensors coupled to the fluid plumbing and storing values of the inputs by a data acquisition system. A fourteenth example is the method of example 7, example 8, example 9, example 10, example 11, example 12, or example 13, wherein circulating the first test fluid, the second test fluid, or both comprises pumping the first test fluid by the fluid pump at different flow rates at different times. A fifteenth example is the method of example 7, example 8, example 9, example 10, example 11, example 12, example 13, or example 14, wherein circulating the first test fluid, the second test fluid, or both comprises pumping the first test fluid by the fluid pump at different pressure differentials at different times.

In a sixteenth example, a method of testing a fluid pump comprises connecting a fluid pump to fluid plumbing; providing mechanical torque to the fluid pump from an electric motor; circulating a first test fluid from a first fluid tank via the fluid plumbing through the fluid pump and back to the first fluid tank; collecting performance data associated with the fluid pump pumping the first test fluid from a torque sensor, from a flow sensor, from a first pressure sensor upstream of the fluid pump, and from a second pressure sensor downstream of the fluid pump; removing mechanical torque from the fluid pump; introducing compressed air into the fluid plumbing; driving the first test fluid out of the fluid pump and out of the plumbing and back to the first fluid tank by the compressed air; isolating the compressed air from the fluid plumbing; circulating a second test fluid from a second fluid tank via the fluid plumbing through the fluid pump and back to the second fluid tank, wherein the second test fluid is different from the first test fluid and wherein each different test fluid is associated with a different range of viscosities; collecting performance data associated with the fluid pump pumping the second test fluid; removing mechanical torque from the fluid pump; driving the second test fluid out of the fluid pump and out of the plumbing back to the second fluid tank by the compressed air; and analyzing the performance data to generate a performance report on the fluid pump. In a seventeenth example, the method of example 16 comprises heating the first test fluid, the second test fluid or both. In an eighteenth example, the method of example 16 or example 17 comprises cooling the first test fluid, the second test fluid, or both. A nineteenth example is the method of example 16, example 17, or example 18, wherein the first test fluid and the second test fluid have viscosities in the range from 10 cP to 2,500 cP. A twentieth example is the example method of example 16, example 17, example 18, or example 19, wherein the fluid pump is a multi-stage centrifugal pump configured for service in a wellbore.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A fluid pump test system, comprising:

a fluid pump under test;

a plurality of fluid tanks, each different fluid tank holding a different test fluid;

a fluid plumbing providing a supply fluid flow path for supply of a test fluid from the plurality of tanks to the fluid pump and a return fluid flow path for return of the test fluid from the fluid pump under test to the plurality of fluid tanks;

a plurality of valves coupling the fluid tanks in fluid communication with the fluid plumbing;

a compressed air source coupled to the fluid plumbing; and a data acquisition system that is configured to provide control inputs to the fluid pump test system, to receive sensor outputs from the fluid pump test system, and to generate a performance report on the fluid pump under test.

2. The fluid pump test system of claim 1, comprising a test fluid temperature control system in fluid communication with the supply fluid flow path.

3. The fluid pump test system of claim 1, comprising two fluid tanks, wherein a first fluid tank stores a first test fluid that exhibits a viscosity of 25 cP at about 145 degrees F., 50 cP at about 118 degrees F., 75 cP at about 100 degrees F., 100 cP at about 91 degrees F., and 150 cP at about 75 degrees F.; and a second fluid tank stores a second test fluid that exhibits a viscosity of 200 cP at about 130 degrees F., 300 cP at about 125 degrees F., 500 cP at about 98 degrees F., and 750 cP at about 85 degrees F.

4. The fluid pump test system of claim 3, comprising three fluid tanks, wherein a third fluid tank stores a third test fluid that exhibits a viscosity of 750 cP at about 130 degrees F., 1000 cP at about 125 degrees F., 1250 cP at about 120 degrees F., 1500 cP at about 110 degrees F., 1750 cP at about 105 degrees F., 2000 cP at about 100 degrees F., 2250 cP at about 95 degrees F., and 2500 cP at about 90 degrees F.

5. The fluid pump test system of claim 4, comprising four fluid tanks, wherein a fourth fluid tank stores a fourth test fluid that exhibits a viscosity of 10 centipoise (cP) at about 130 degrees Fahrenheit (F) and 25 cP at about 85 degrees F.

6. The fluid pump test system of claim 1, wherein each different test fluid is associated with a different range of viscosities.

7. The system of claim 1, wherein the fluid pump under test is a multi-stage centrifugal pump configured for service in a wellbore.

8. A method of testing a fluid pump, comprising:

connecting a fluid pump to fluid plumbing;

circulating a first test fluid from a first fluid tank via the fluid plumbing through the fluid pump and back to the first fluid tank;

collecting performance data associated with the fluid pump pumping the first test fluid;

discontinuing the circulating of the first test fluid;

introducing compressed air into the fluid plumbing;

driving the first test fluid out of the fluid pump and out of the plumbing and back to the first fluid tank by the compressed air;

isolating the compressed air from the fluid plumbing;

circulating a second test fluid from a second fluid tank via the fluid plumbing through the fluid pump and back to the second fluid tank, wherein the second test fluid is different from the first test fluid; and collecting performance data associated with the fluid pump pumping the second test fluid.

9. The method of claim 8, comprising connecting a drive shaft of the fluid pump to a drive shaft of an electric motor.

10. The method of claim 8, comprising heating the first test fluid, the second test fluid, or both.

11. The method of claim 8, comprising cooling the first test fluid, the second test fluid, or both.

12. The method of claim 8, wherein driving the first test fluid back to the first fluid tank comprises driving the first test fluid through a first evacuation valve.

13. The method of claim 8, wherein introducing compressed air comprises opening an air supply valve and isolating the compressed air comprises closing the air supply valve.

14. The method of claim 8, wherein collecting performance data comprises receiving inputs from sensors coupled to the fluid plumbing and storing values of the inputs by a data acquisition system.

15. The method of claim 8, wherein circulating the first test fluid, the second test fluid, or both comprises pumping the first test fluid by the fluid pump at different flow rates at different times.

16. The method of claim 8, wherein circulating the first test fluid, the second test fluid, or both comprises pumping the first test fluid by the fluid pump at different pressure differentials at different times.

17. A method of testing a fluid pump, comprising:

connecting a fluid pump to fluid plumbing;

providing mechanical torque to the fluid pump from an electric motor;

circulating a first test fluid from a first fluid tank via the fluid plumbing through the fluid pump and back to the first fluid tank;

collecting performance data associated with the fluid pump pumping the first test fluid from a torque sensor, from a flow sensor, from a first pressure sensor upstream of the fluid pump, and from a second pressure sensor downstream of the fluid pump;

removing mechanical torque from the fluid pump;

introducing compressed air into the fluid plumbing;

driving the first test fluid out of the fluid pump and out of the plumbing and back to the first fluid tank by the compressed air;

isolating the compressed air from the fluid plumbing;

circulating a second test fluid from a second fluid tank via the fluid plumbing through the fluid pump and back to the second fluid tank, wherein the second test fluid is different from the first test fluid;

collecting performance data associated with the fluid pump pumping the second test fluid;

removing mechanical torque from the fluid pump;

driving the second test fluid out of the fluid pump and out of the plumbing back to the second fluid tank by the compressed air; and analyzing the performance data to generate a performance report on the fluid pump.

18. The method of claim 17, comprising heating the first test fluid, the second test fluid or both.

19. The method of claim 17, comprising cooling the first test fluid, the second test fluid, or both.

20. The method of claim 17, wherein the first test fluid and the second test fluid have viscosities in the range from 10 cP to 2,500 cP.

* * * * *